US005452750A

United States Patent [19]

Miller et al.

[11] Patent Number: 5,452,750

[45] Date of Patent: Sep. 26, 1995

[54] MANUALLY ACTIVATED VAPOR VALVE FOR GASOLINE DISPENSERS

[75] Inventors: Paul D. Miller; James R. McMordie, both of Winston-Salem, N.C.

[73] Assignee: Gilharco, Inc., Greensboro, N.C.

[21] Appl. No.: 160,942

[22] Filed: Dec. 3, 1993

[51] Int. Cl.[6] ..... B65B 31/00; B67C 3/00

[52] U.S. Cl. ..... 141/7; 141/45; 141/59; 141/302; 222/75

[58] Field of Search ..... 141/1, 7, 44, 45, 141/46, 59, 302, 97, 285, 301; 222/75, 75

[56] References Cited

U.S. PATENT DOCUMENTS

| | | | |
|---|---|---|---|
| 2,037,141 | 4/1936 | Nelson . | |
| 3,900,056 | 8/1975 | Giardini et al. | 141/93 |
| 3,905,405 | 9/1975 | Fowler et al. | 141/46 |
| 3,913,673 | 10/1975 | Hiller | 141/45 |
| 3,915,206 | 10/1975 | Fowler et al. | 141/59 |
| 3,941,168 | 3/1976 | Hiller et al. | 141/46 |
| 3,952,781 | 4/1976 | Hiller et al. | 141/46 |
| 3,981,334 | 9/1976 | Deters | 141/46 |
| 3,981,335 | 9/1976 | Deters | 141/46 |
| 3,982,571 | 9/1976 | Fenton et al. | 141/225 |
| 4,213,488 | 7/1980 | Pyle | 141/1 |
| 4,232,715 | 11/1980 | Pyle | 141/1 |
| 4,260,000 | 4/1981 | McGahey et al. | 141/59 |
| 4,429,725 | 2/1984 | Walker et al. | 141/59 |
| 4,611,729 | 9/1986 | Gerstenmaier et al. | 222/75 |
| 4,649,970 | 3/1987 | Bower et al. | 141/302 |
| 5,038,838 | 8/1991 | Bergamini et al. | 141/59 |
| 5,040,577 | 8/1991 | Pope | 141/59 |
| 5,048,577 | 9/1991 | Kuusisto | 141/293 |
| 5,110,010 | 5/1992 | Smith | 222/75 |
| 5,156,199 | 10/1992 | Hartsell, Jr. et al. | 141/59 X |
| 5,195,564 | 3/1993 | Spalding | 141/59 |
| 5,269,353 | 12/1993 | Nanaji et al. | 141/59 |
| 5,323,817 | 6/1994 | Spalding | 141/59 |
| 5,332,008 | 7/1994 | Todd et al. | 141/59 |
| 5,332,011 | 7/1994 | Spalding | 141/59 |
| 5,345,979 | 9/1994 | Tucker et al. | 141/1 |

*Primary Examiner*—Henry J. Recla
*Assistant Examiner*—Steven O. Douglas
*Attorney, Agent, or Firm*—Rhodes, Coates & Bennett

[57] ABSTRACT

A method of recovering fuel vapors using a fuel dispenser having first and second sets of associated liquid flow lines, vapor flow lines, nozzles and nozzle rests includes removing the first nozzle from the first nozzle rest, inserting the first nozzle into a fill pipe of a receptacle, moving the first nozzle rest, thereby transmitting motion through a mechanical linkage from the first nozzle rest to a first normally-closed valve in the first vapor flow line to open the first normally-closed valve and turning on a first pump in the first liquid fuel line, pumping liquid fuel from a first tank through the dispenser out the first nozzle into the receptacle, and pumping fuel vapor from the first nozzle through the first vapor flow line to a manifold which has a connection to the second vapor flow line and communicates with the tanks, the second vapor flow line being closed by its normally-closed vapor valve.

25 Claims, 3 Drawing Sheets

MANUALLY ACTIVATED VAPOR VALVE FOR GASOLINE DISPENSERS

BACKGROUND OF THE INVENTION

The present invention relates to improvements in vapor recovery fuel dispensers and specifically with an improved mechanism for actuating a valve in the vapor line of a vapor recovery fuel dispenser.

Although vapor recovery fuel dispensers have been known for a number of years, progress continues to be made in improving the ease of use, efficiency and economy of such fuel dispensers. A particularly advantageous advance in this field was the VaporVac™ Vapor Recovery Fuel Dispenser marketed by Gilbarco, Inc., of Greensboro, N.C. In the VapoNac™ line of fuel dispensers, a vapor pump is provided in the vapor return line to draw vapor into the system as it is displaced from an automobile fuel tank as liquid fuel is dispensed into the tank through a nozzle. The nozzle is provided with openings into which the vapor passes under the influence of the vapor pump, and the vapor is directed to underground storage tanks to occupy the volume displaced by the liquid being pumped therefrom.

In one commercial embodiment of the VapoNac™ product, multiple hoses are used on a single dispenser, each having its own vapor return line. Solenoid valves in each vapor return line in the dispenser are normally closed, but one is opened when its associated vapor line is to be activated. Down stream of the solenoid valves, the multiple vapor lines are merged together in a manifolded fashion so that only one vapor pump is needed. Providing the solenoid valves assures that the vapor being pumped comes from the active hose. It also prevents the escape of vapor during idle periods.

Also known is the provision of multiple hoses having vapor valves located in the nozzles, as taught in U.S. Pat. No. 5,195,564 to Spalding. However, in the case of both the VaporVac™ solenoid valves and the Spalding nozzle-located valves, there are certain disadvantages. Solenoid valves are rather expensive, and it would be advantageous if their use could be avoided. Similarly, the nozzle-located valves experience short life-times requiring high replacement cost because the nozzles in which they are located are subject to exposure to the elements and to abuse. Since the valve is located in the nozzle, replacement of either requires replacement of the other, even if replacement is not needed.

Accordingly, there is a need in the art for an improved valve for a vapor return line and a vapor recovery fuel dispenser.

SUMMARY OF THE INVENTION

The present invention fulfills this need in the art by providing a vapor recovery fuel dispenser including a dispenser housing, and a liquid fuel flow line through the housing from a fuel tank to a hose terminating in a nozzle for conveying liquid fuel from the tank and out the nozzle. A vapor flow line passes through the housing from the hose to the fuel tank for conveying fuel vapor from the hose to the tank, and a nozzle rest is included on the dispenser housing on which the nozzle may be stored when not in use and movable when the nozzle is removed. A normally-closed valve is included in the vapor flow line in the housing, and a mechanical linkage from the nozzle rest to the normally-closed valve opens the normally-closed valve when the nozzle rest is moved. Thus, upon removal of the nozzle from the rest and movement of the nozzle rest, the valve is opened to permit vapor to be returned from the hose to the tank.

Typically, a liquid pump in the liquid fuel line pumps liquid fuel through the liquid fuel line and a switch turns on the pump when the nozzle rest is moved. Preferably, a vapor pump is included in the vapor flow line for pumping vapor through the vapor flow line.

The nozzle rest may take the form of a first class lever pivotable about a fulcrum, whereby movement of one end of the nozzle rest in one direction moves an opposite end of the lever an opposite direction, and the linkage is connected to the opposite end to transmit movement of the opposite end to the valve. Or, the nozzle rest may take the form of a second class lever pivotable about a fulcrum, whereby movement of one end of the nozzle rest in one direction moves a mid-portion of the lever in the same direction, but by a lesser amount and the linkage is connected to the mid-portion to transmit movement of the mid-portion to the valve. In another possible embodiment the nozzle rest is slidably mounted on the housing, and the linkage is moved by sliding the nozzle rest to open the vapor valve. Other mechanical linkages may be used.

A preferred embodiment includes a plurality of liquid flow lines, vapor flow lines, nozzles and nozzle rests associated with one dispenser housing. The plurality of vapor flow lines may include a common manifold which communicates with the tank. A vapor pump in the common manifold pumps vapor through an active one of the vapor flow lines, inactive vapor flow lines being closed by their respective normally-closed vapor valves.

The invention also provides a method of recovering fuel vapors including removing a nozzle from a nozzle rest on a fuel dispenser, and inserting the nozzle into a fill pipe of a receptacle. The method proceeds by moving the nozzle rest, thereby transmitting motion through a mechanical linkage from the nozzle rest to a normally-closed valve to open the valve in the vapor flow line, conveying liquid fuel from the tank through the dispenser out the nozzle into the receptacle, and conveying fuel vapor from the nozzle to the tank through a vapor flow line through the housing.

The moving step typically includes turning on a pump to pump liquid fuel through the liquid fuel line when the nozzle rest is moved. In a preferred embodiment the vapor conveying step includes pumping vapor through the vapor flow line.

The moving step may take the form of pivoting one end of a first class lever about a fulcrum, thereby moving an opposite end of the lever an opposite direction to transmit movement of the opposite end to the valve. In an alternate embodiment the moving step includes moving a handle end of a second class lever about a fulcrum, thereby moving a portion of the lever between the handle end and the fulcrum in the same direction, but by a lesser amount to transmit movement of the portion to the valve. In another embodiment the moving step takes the form of sliding the nozzle rest in the housing to transmit movement of the nozzle rest to the valve.

Preferably the method is carried out using a fuel dispenser having a plurality of sets of liquid flow lines, vapor flow lines, nozzles and nozzle rests, and the removing, inserting, moving and liquid and vapor conveying steps are all carried out with one set of liquid flow lines, vapor flow lines, nozzles and nozzle rests. However, the vapor conveying step preferably includes conveying vapor to a manifold which has connections to vapor flow lines of other sets and communicates with the tanks. More preferably, the vapor conveying step includes pumping vapor in the common manifold to draw vapor through the active one of the vapor flow lines, inactive vapor flow lines being closed by their respective normally-closed vapor valves.

BRIEF DESCRIPTION OF THE DRAWINGS

The invention will be better understood after a reading of the Detailed Description of the Preferred Embodiments, along with a study of the Drawings in which.

DETAILED DESCRIPTION OF THE PREFERRED EMBODIMENTS

Figure 1:
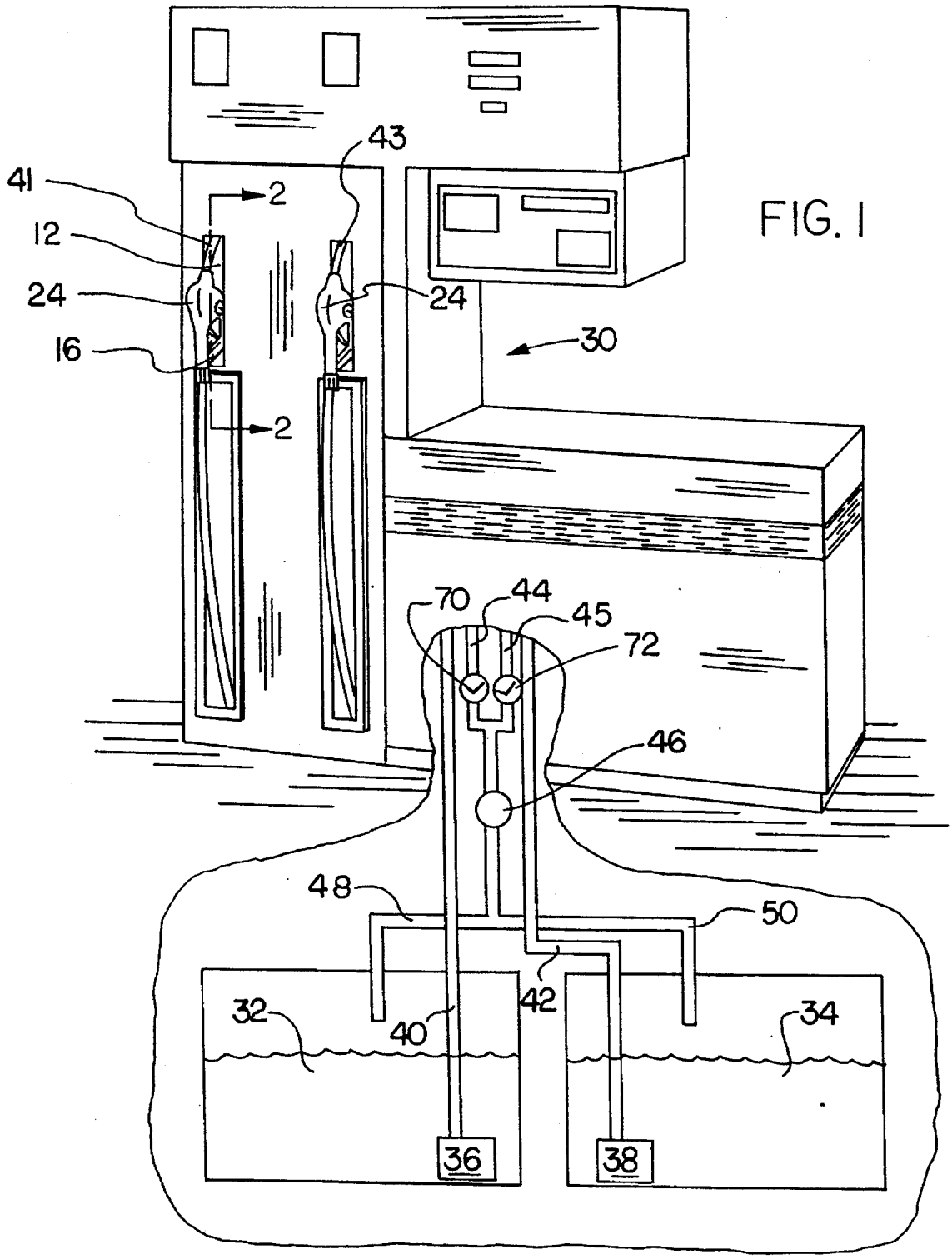
FIG. 1 is a perspective view, partially schematic, of a fuel dispenser and underground piping in connection with an embodiment of the invention.

Referring to FIG. 1, there is shown a fuel dispenser 30 provided to dispense multiple grades of fuel, as shown by the provision of multiple hoses and nozzles 24. Each of the nozzles and hoses in the dispenser are generally identical in construction, differing only in the grades of fuel dispensed. Accordingly, the following description will be made with respect to only one of the nozzles, it being understood that the hose, piping and valving for the other is generally the same. Although the dispenser 30 is shown capable of dispensing two grades of fuel, other numbers of grades could also be dispensed, with readily apparent modifications.

Figure 3:
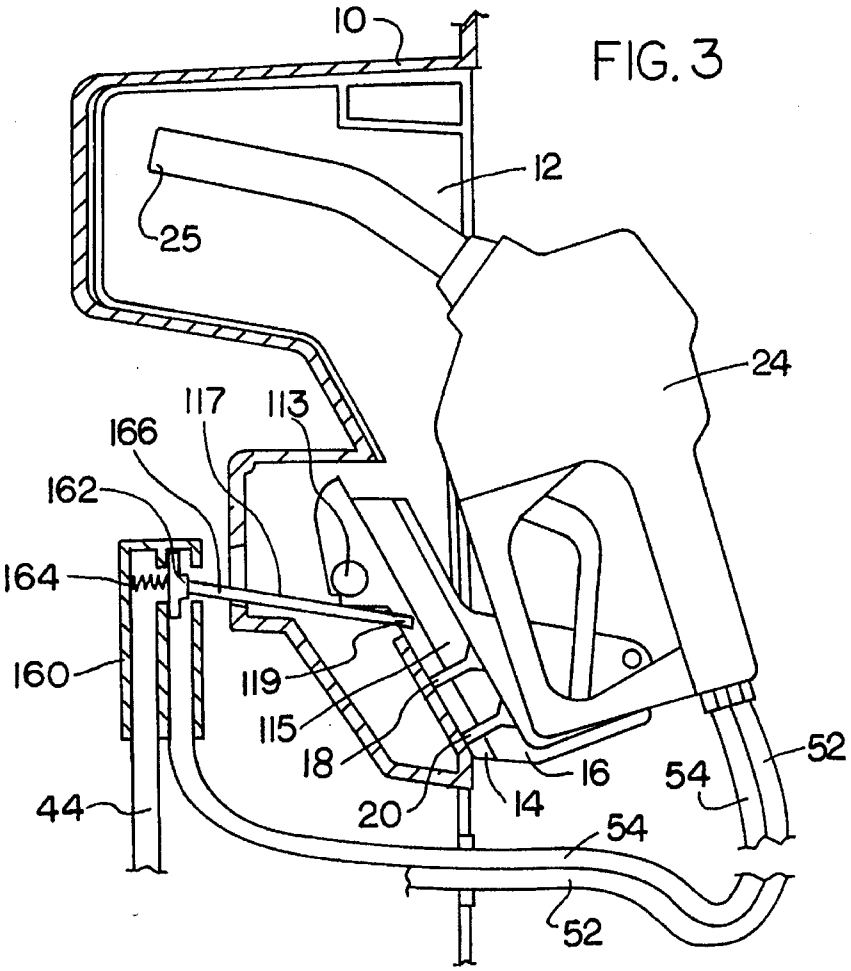
FIG. 3 is a sectional view of a first alternate embodiment, taken along lines 2—2 in FIG. 1 and looking in the direction of the arrows.
Figure 2:
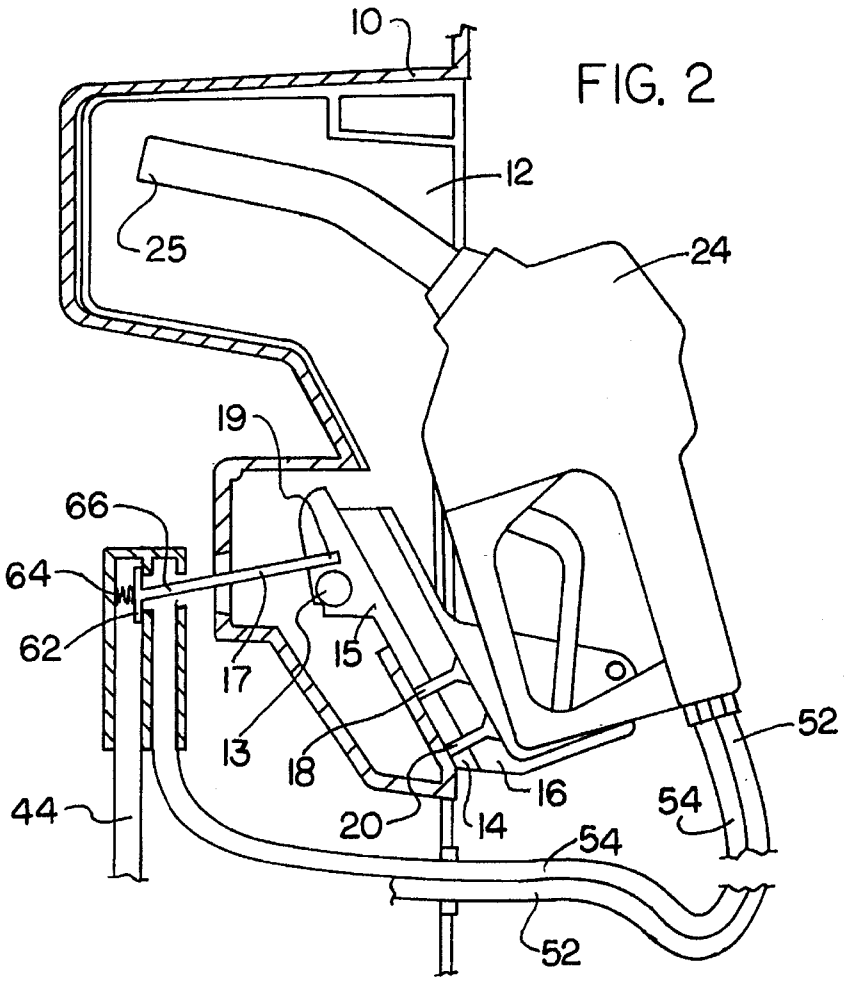
FIG. 2 is a sectional view taken along lines 2—2 in FIG. 1 and looking in the direction of the arrows.
Figure 4:
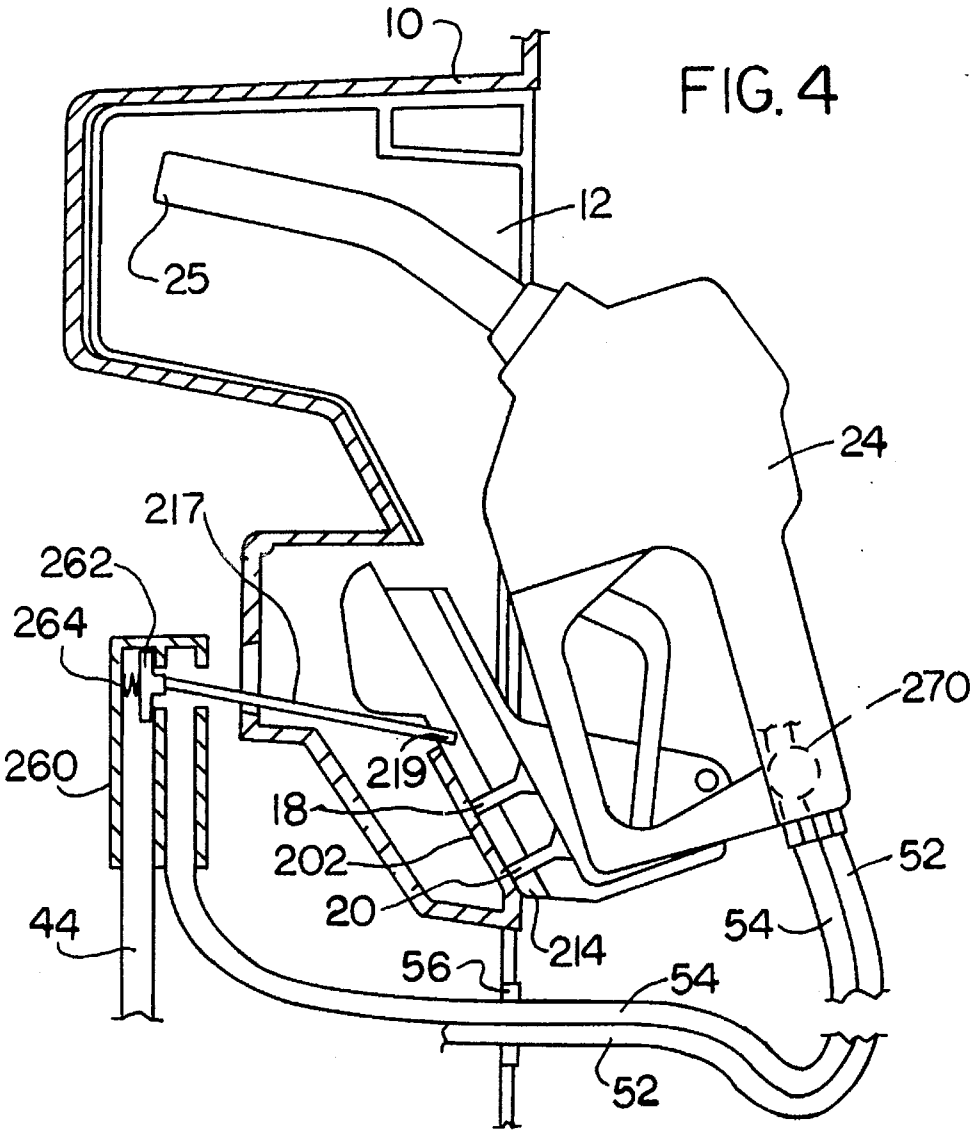
FIG. 4 is a sectional view of a second alternate embodiment, taken along lines 2—2 in FIG. 1 and looking in the direction of the arrows.

As better seen in FIGS. 2–4, each nozzle 24 is connected to a hose having a liquid supply line 52 and a vapor return line 54, as is conventional. Each nozzle 24 is also provided with a vapor return spout 25 having an outer annular passageway for vapors to be returned through the vapor return line 54. Also as seen in FIGS. 2–4, the vapor return line 54 and liquid flow line have a common fitting 56 to the housing of dispenser 30. Provided within the housing of dispenser 30 are nozzle cradles 12 including a nozzle rest 16 on which the nozzle 24 is positioned when not in use. The nozzle rest can take any of various forms including boots, levers and other devices known in the art.

The dispenser 30 has each of its hoses connected to underground tanks for the supply of liquid fuel and return of vapors. Thus, underground tanks 32 and 34 are provided, each containing a separate grade of gasoline to be dispensed through the dispenser 30. Tank 32 is provided with pump 36 outletting liquid fuel along line 40 to the dispenser through nozzle spout 41. Similarly, tank 34 is provided with liquid pump 38 outletting the liquid from the tank 34 along line 42 to the nozzle spout 43. The means and mechanism for pumping the liquid and recording its sale are very well known in the art and need no elaboration here.

The vapor return hose portions 54 are connected interiorly of the housing of dispenser 30 to vapor return lines 44 as shown in FIGS. 2–4. As shown schematically in FIG. 1, the vapor return lines 44, 45 for the two grades of fuel are provided with check valves 72,70 that prevent the release of vapor back through the nozzles when the manual valve is open. The check valves, of course, are designed to open when the pressure in the lines 44, 45 is greater on the side of the valve toward the nozzle than away from the nozzle. Downstream of the check valves, the lines 44,45 are merged or manifolded before reaching a vapor pump 46. The check valves can be located at any of various locations along the vapor return line, such as in the nozzles, at hose fittings to the nozzles or the dispenser 30, in the line downstream of the merger of lines 44 and 45, or downstream of the pump 46. Downstream of the vapor pump 46, the vapors are returned along lines 48 and 50 to the underground tanks 34 and 32. In normal practice, all of the vapors are returned to the lowest grade fuel tank, with the pressure between the various underground tanks being equalized by connections in the domes of the underground tanks. Also, it is preferable to make the manifold connection of lines 44, 45 as close to the respective fittings 56 for the two grades as possible in order to minimize the needed piping.

Referring again to FIG. 2, nozzle 24 is shown being supported on nozzle rest 16, secured by screws 18 and 20 to pivot plate 15. Pivot plate 15 is adapted to rotate about pivot 13 when the nozzle 24 is removed from the nozzle rest 16. A linkage 17 is pivotally linked at 19 to the pivot plate 15 and has its other end passing through the housing of vapor valve 60 to contact the valve plate 62. Spring 64 is normally urged to close the valve plate 62, thereby separating the vapor line 44 from the vapor line 54, so a suction applied along line 44 will not draw vapors through the hose 54. However, when the nozzle rest 16 is lifted, so as to pivot the pivot plate 15 around pivot 13, the linkage 17 is driven to the left as seen in FIG. 2 to open the valve and put the vapor hose 54 into communication with the vapor return line 44. Also, as is conventional, therefore not shown, the lifting of the nozzle rest 16 actuates a switch to turn on the underground pump of the associated one of the tanks 32 or 34.

FIG. 3 shows a modified version of the actuating apparatus shown in FIG. 2. Rather than the first-class lever shown in FIG. 2, the pivot plate 115 of FIG. 3 forms a second-class lever. Thus, the linkage arm 117 has one end 119 connected between the pivot point 113 and the distal, lower portion of the nozzle rest 16. The other end 166 passes through a wall of the vapor valve 160 to make a pivoted connection to the valve plate 162. A tension spring 164 normally urges the valve plate 162 to the left to close the passage between the vapor return line 44 and vapor hose 54.

However, when the nozzle 24 is removed from the nozzle rest 16 and the nozzle rest is pivoted about the pivot 113, the linkage arm 117 is pulled to the right, acting against the spring 164, thereby opening the connection between the vapor hose 54 and the vapor return line 44.

FIG. 4 shows another embodiment of the valving arrangement in which the nozzle rest does not pivot, but rather has a longitudinal sliding motion, The nozzle rest in this case slides along the surface between plate 21 4 and plate 202. Such sliding mechanisms for on/off activation of fuel dispensers are conventional and details of construction are, therefore, are not needed to be shown to those of ordinary skill in the art. Also in this embodiment, the check valve 270 is located in the nozzle 24, rather than in the vapor flow line in the dispenser. The check valve could just as well be in the dispenser in this embodiment, or in the nozzle in the other embodiments.

Linkage arm 217 has one end 219 pivotally connected to the plate 214 and has its other end passing into the valve 260 and connected to the right-hand side of the valve plate 262. Valve 262 is normally urged to the right by compression spring 264 to close off the passageway between vapor hose 54 and vapor return line 44. However, when the plate 214 is pushed up to turn the liquid pump on, the linkage arm 217 is pushed to the left, thereby acting against the spring 264 to provide passage between the vapor return hose 54 and vapor return line 44.

As will be appreciated, the drawings of FIGS. 2–4 are rather schematic, and various other linkage mechanisms between a vapor valve and nozzle rest can be employed and are deemed to be within the scope of this invention. Furthermore, the details of the mechanism for switching on the liquid pump (as well as the vapor pump), are not shown, for the purposes of simplicity, since these are well known to those of ordinary skill in the art.

In operation, when liquid fuel is to be dispensed from the dispenser 30, one of the nozzles 24 is removed from its associated nozzle rest 16 and inserted into the filler pipe of the tank to be filled. The associated nozzle rest is then lifted, thereby switching on the associated pump 36 or 38 to provide pressurized liquid fuel to the selected nozzle. Simultaneously, the lifting of the nozzle rest opens the vapor valve associated with that nozzle and hose. At a selected time, the vapor pump 46 begins pumping. If desired, the vapor pump 46 can be begun before, after or at the time the liquid pumps are actuated, or at the time that liquid flow is actually sensed, since the liquid does not flow through the liquid lines until the manually operated liquid valve located in the nozzle 24 is opened.

Since the vapor valve associated with the active, liquid-dispensing hose has been opened by the lifting of its nozzle rest, the vapor will be drawn from that nozzle, rather than the other nozzle (since its vapor valve is closed) and be returned via the vapor pump 46 to the underground tanks 32 and 34 through lines 48 and 50. Upon completion of the dispensing operation, the nozzle rest is lowered, thereby closing the vapor valve, turning off the underground pump and providing an appropriate operating condition for the next fuel dispensing transaction. That is, if the next transaction uses the other hose, the vapor valve for the just-used hose will be closed, so that the vapor taken in under the influence of pump 46 will be through the vapor return line of the newly-active hose.

Those of ordinary skill in the art will appreciate that the invention can be carried out in various respects different from those specifically described herein, and those are deemed to be within the scope of the invention. For example, other manual connections to open and close the valves can be substituted. Various conventional on/off levers and actuators can be modified to include a link to open and close the valve. All such devices are deemed to fall within the term "nozzle rest" as used herein.

What is claimed:

1. A vapor recovery fuel dispenser comprising a dispenser housing, a liquid fuel flow line through said housing from a fuel tank to a hose terminating in a nozzle for conveying liquid fuel from said tank and out said nozzle, a vapor flow line through said housing from said hose to said fuel tank for conveying fuel vapor from said hose to said tank, a nozzle rest on said dispenser housing on which said nozzle may be stored when not in use and movable when said nozzle is removed, and a normally-closed valve in said vapor flow line in said housing and a mechanical linkage from said nozzle rest to said normally-closed valve to open said normally-closed valve when said nozzle rest is moved, whereby upon removal of said nozzle from said rest and movement of said nozzle rest, said valve is opened to permit vapor to be returned from said hose to said tank.

2. A vapor recovery fuel dispenser as claimed in claim 1 further comprising a liquid pump in said liquid fuel line for pumping liquid fuel through said liquid fuel line and a switch for turning on said pump when said nozzle rest is moved.

3. A vapor recovery fuel dispenser as claimed in claim 1 further comprising a vapor pump in said vapor flow line for pumping vapor through said vapor flow line.

4. A vapor recovery fuel dispenser as claimed in claim 3 further comprising a switch for activation of said vapor pump and check valve in said vapor flow line to prevent vapor from escaping from said vapor flow line out said hose when said normally-closed valve is opened and before said vapor pump is activated.

5. A vapor recovery fuel dispenser as claimed in claim 1 wherein said nozzle rest takes the form of a first class lever pivotable about a fulcrum, whereby movement of one end of the nozzle rest in one direction moves an opposite end of the lever an opposite direction, and said linkage is connected to said opposite end to transmit movement of said opposite end to said valve.

6. A vapor recovery fuel dispenser as claimed in claim 1 wherein said nozzle rest takes the form of a second class lever pivotable about a fulcrum, whereby movement of one end of the nozzle rest in one direction moves a mid-portion of the lever in the same direction, but by a lesser amount and said linkage is connected to said mid-portion to transmit movement of said mid-portion to said valve.

7. A vapor recovery fuel dispenser as claimed in claim 1 wherein said nozzle rest is slidably mounted on said housing and said linkage is moved by sliding said nozzle rest to open said vapor valve.

8. A vapor recovery fuel dispenser as claimed in claim 1 further comprising a plurality of liquid flow lines, vapor flow lines, nozzles and nozzle rests associated with one dispenser housing.

9. A vapor recovery fuel dispenser as claimed in claim 8 wherein said plurality of vapor flow lines include a common manifold which communicates with said tank.

10. A vapor recovery fuel dispenser as claimed in claim 1 further comprising a check valve in said vapor flow line to prevent reverse flow of vapor from said tank toward said hose.

11. A vapor recovery fuel dispenser as claimed in claim 1 further comprising a check valve in said nozzle to prevent reverse flow of vapor out of said nozzle.

12. A vapor recovery fuel dispenser comprising a. a dispenser housing, b. a plurality of liquid fuel flow lines through .said housing, each of which 1) extends from an associated fuel tank and 2) includes a hose terminating in a nozzle and a liquid pump for pumping liquid fuel for conveying liquid fuel from its associated tank and out its associated nozzle, c. a plurality of vapor flow lines through said housing, each vapor flow line being associated with a liquid flow line and extending from its associated hose to a common manifold whereby fuel vapor from the hoses may be conveyed to said tanks, including a vapor pump for pumping vapor through said common manifold and a switch for activation of said vapor pump, d. a plurality of nozzle rests on said dispenser housing, each of which
   1) is associated with a liquid flow line and on which its associated nozzle may be stored when not in use,
   2) is movable when its associated nozzle is removed, and
   3) includes a switch for turning on said liquid pump when said nozzle rest is moved, and e. normally-closed valves in said vapor flow lines and mechanical linkages from said nozzle rests to associated normally-closed valve to open said normally-closed valve when its associated nozzle rest is moved, f. check valves in said vapor flow lines to prevent vapor from escaping from a vapor flow line out its associated hose when its normally-closed valve is opened and before said vapor pump is activated, whereby upon removal of a nozzle from its associated nozzle rest and movement of its associated nozzle rest, its associated valve is opened to permit vapor to be returned from its associated hose to said tank, but the other normally closed valves remain closed.

13. A method of recovering fuel vapors comprising removing a nozzle from a nozzle rest on a fuel dispenser, inserting the nozzle into a fill Pipe of a receptacle, moving the nozzle rest, thereby transmitting motion through a mechanical linkage from the nozzle rest to a normally-closed valve to open the normally-closed valve, conveying liquid fuel from the tank through the dispenser out the nozzle into the receptacle, and conveying fuel vapor from the nozzle to the tank through a vapor flow line through the housing.

14. A method of recovering fuel vapors as claimed in claim 13 wherein said moving step further comprises turning on a pump to pump liquid fuel through the liquid fuel line when the nozzle rest is moved.

15. A method of recovering fuel vapors as claimed in claim 13 wherein said vapor conveying step further comprises pumping vapor through the vapor flow line.

16. A method of recovering fuel vapors as claimed in claim 15 further comprising activating a switch of said vapor pump and maintaining pressure downstream of a check valve in said vapor flow line to prevent vapor from escaping from the vapor flow line out said hose when the normally-closed valve is opened and before activating the vapor pump.

17. A method of recovering fuel vapors as claimed in claim 13 wherein said moving step comprises pivoting one end of a first class lever about a fulcrum, thereby moving an opposite end of the lever an opposite direction to transmit movement of the opposite end to the valve.

18. A method of recovering fuel vapors as claimed in claim 13 wherein said moving step comprises moving a handle end of a second class lever about a fulcrum, thereby moving a portion of the lever between the handle end and the fulcrum in the same direction, but by a lesser amount to transmit movement of the portion to the valve.

19. A method of recovering fuel vapors as claimed in claim 13 wherein said moving step comprises sliding the nozzle rest in the housing to transmit movement of the nozzle rest to the valve.

20. A method of recovering fuel vapors as claimed in claim 13 using a fuel dispenser having a plurality of sets of liquid flow lines, vapor flow lines, nozzles and nozzle rests, wherein said removing, inserting, moving and liquid and vapor conveying steps are all carried out with one set of liquid flow lines, vapor flow lines, nozzles and nozzle rests.

21. A method of recovering fuel vapors as claimed in claim 20 wherein said vapor conveying step includes conveying vapor to a manifold which has connections to vapor flow lines of other sets and communicates with the tanks.

22. A method of recovering fuel vapors as claimed in claim 13 wherein said vapor conveying step further comprises opening a check valve.

23. A method of recovering fuel vapors using a fuel dispenser having first and second sets of associated liquid flow lines, vapor flow lines, nozzles and nozzle rests comprising removing the first nozzle from the first nozzle rest, inserting the first nozzle into a fill pipe of a receptacle, moving the first nozzle rest, thereby transmitting motion through a mechanical linkage from the first nozzle rest to a first normally-closed valve in the first vapor flow line to open the first normally-closed valve and turning on a first pump in the first liquid fuel line, maintaining pressure downstream of a check valve in said vapor flow line to prevent vapor from escaping from the vapor flow line out said hose when the first normally-closed valve is opened, pumping liquid fuel from a first tank through the dispenser out the first nozzle into the receptacle, and pumping fuel vapor from the first nozzle past the check valve and through the first vapor flow line to a manifold which has a connection to the second vapor flow line and communicates with the tanks, the second vapor flow line being closed by its normally-closed vapor valve.

24. A vapor recovery fuel dispenser comprising a dispenser housing, a plurality of liquid fuel flow lines through said housing from fuel tanks to hoses terminating in nozzles for conveying liquid fuel from said tanks and out said nozzles, a plurality of vapor flow lines through said housing from said hoses to said fuel tanks for conveying fuel vapor from said hose to said tanks including a common manifold which communicates with at least one of said tanks, a plurality of nozzle rests on said dispenser housing on which said nozzles may be stored when not in use and movable when said nozzles are removed, a normally-closed valve in each of said vapor flow lines in said housing and a mechanical linkage from an associated nozzle rest to said normally-closed valve to open said normally-closed valve when said nozzle rest is moved, and a vapor pump in said common manifold for pumping vapor through an active one of said vapor flow lines, inactive vapor flow lines being closed by their respective normally-closed vapor valves, whereby upon removal of one of said nozzles from an associated nozzle rest and movement of said associated nozzle rest, said valve is opened to permit vapor to be returned from said hose to said tank.

25. A method of recovering fuel vapors using a fuel dispenser having a plurality of sets of liquid flow lines, vapor flow lines, nozzles and nozzle rests, comprising removing one of the nozzles from one of the nozzle rests on the fuel dispenser, inserting the removed nozzle into a fill pipe of a receptacle, moving the nozzle rest from which the nozzle was removed and thereby transmitting motion through a mechanical linkage from the nozzle rest to a normally-closed valve to open the normally-closed valve, conveying liquid fuel from the tank through a liquid flow line associated with the removed nozzle through the dispenser and out the removed nozzle into the receptacle, and conveying fuel vapor from the removed nozzle to the tank through a vapor flow line through the housing, including pumping vapor in a common manifold to draw vapor through the active one of the vapor flow lines, inactive vapor flow lines being closed by respective normally-closed vapor valves.

* * * * *

UNITED STATES PATENT AND TRADEMARK OFFICE

CERTIFICATE OF CORRECTION

PATENT NO. : 5,452,750

DATED : September 26, 1995

INVENTOR(S) : Paul D. Miller et al.

It is certified that error appears in the above-indentified patent and that said Letters Patent is hereby corrected as shown below:

On the title page, item [73]: the Assignee has been misspelled. The correct spelling is "GILBARCO."

Column 6, line 3, there should not be a period before the word "said."

Column 7, line 3, "pipe" should not be capitalized.

Signed and Sealed this

Twenty-sixth Day of December, 1995

*Attest:*

*Attesting Officer*

BRUCE LEHMAN

*Commissioner of Patents and Trademarks*